US006858095B2

(12) United States Patent
Yoshitomi et al.

(10) Patent No.: US 6,858,095 B2
(45) Date of Patent: Feb. 22, 2005

(54) THICK GRAIN-ORIENTED ELECTRICAL STEEL SHEET EXHIBITING EXCELLENT MAGNETIC PROPERTIES

(75) Inventors: Yasunari Yoshitomi, Kitakyushu (JP); Hiroaki Masui, Kitakyushu (JP); Nobuyuki Takahashi, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/783,408

(22) Filed: Feb. 14, 2001

(65) Prior Publication Data

US 2001/0042576 A1 Nov. 22, 2001

Related U.S. Application Data

(63) Continuation-in-part of application No. 08/116,152, filed on Sep. 2, 1993, now abandoned.

(30) Foreign Application Priority Data

Sep. 4, 1992 (JP) ..... 4-237150

(51) Int. Cl.[7] ..... C11D 8/00
(52) U.S. Cl. ..... 148/111; 148/112
(58) Field of Search ..... 148/111, 112

(56) References Cited

U.S. PATENT DOCUMENTS

| | | | | |
|---|---|---|---|---|
| 3,932,234 A | | 1/1976 | Imanaka et al. | |
| 3,969,162 A | | 7/1976 | Henke | 148/308 |
| 4,054,471 A | | 10/1977 | Datta | 148/308 |
| 4,318,758 A | | 3/1982 | Kuroki et al. | 148/308 |
| 4,595,426 A | * | 6/1986 | Iwayama et al. | 148/111 |
| 4,979,996 A | * | 12/1990 | Kobayashi et al. | 148/111 |
| 5,190,597 A | * | 3/1993 | Kobayashi et al. | 148/111 |

FOREIGN PATENT DOCUMENTS

| | | |
|---|---|---|
| DE | 3538609 | 5/1986 |
| EP | 219611 | 4/1987 |
| EP | 378131 | 7/1990 |
| EP | 390142 | 10/1990 |
| EP | 539858 | 5/1993 |
| JP | 40-15644 | 7/1965 |
| JP | 51-13469 | 4/1976 |

OTHER PUBLICATIONS

Chemical Abstracts, vol. 115, No. 12, Sep. 23, 1991, p. 239, Col. 2, Abstract No. 118412g, "Manufacture of Unidirectional Steel Sheet . . . ", T. Kobayahsi et al.
Chemical Abstracts, vol. 106, No. 22, Jun. 1, 1987, p. 271, Col. 1, Abstract No. 180 666K, "Magnetic Oriented Silicon Steel Sheets", Y. Kobayashi et al.
Chemical Abstract, vol. 116, No. 4, Jan. 27, 1992, p. 292, Col. 2, Abstract No. 25 611b, "Manufacture of Unidirectional Steel Sheets . . . ", S. Nakajima et al.
Patent Abstracts of Japan, 4–59928, Jun. 12, 1992.
Patent Abstracts of Japan, 4–59929, Jun. 12, 1992.

* cited by examiner

*Primary Examiner*—Sikyin Ip
(74) *Attorney, Agent, or Firm*—Kenyon & Kenyon

(57) ABSTRACT

A grain-oriented electrical steel sheet comprising 2.5–4.5% Si by weight and measuring 0.36–1.00 mm in thickness is imparted with a good core loss value for its thickness by controlling its C content, flux density, grain boundary configuration, and deviation degree of crystal orientation in the grains.

3 Claims, 4 Drawing Sheets

THICK GRAIN-ORIENTED ELECTRICAL STEEL SHEET EXHIBITING EXCELLENT MAGNETIC PROPERTIES

CROSS-REFERENCING

This application is a continuation-in-part under 35 U.S.C. §120 of prior application Ser. No. 08/116,152 filed Sep. 2, 1993 ABN, the benefit of which is claimed. The disclosure of the specification, claims, abstract and drawings of prior application Ser. No. 08/116,152 filed Sep. 2, 1993 is hereby incorporated by reference.

BACKGROUND OF THE INVENTION

1. Field of the Invention

This invention relates to a thick grain-oriented electrical steel sheet exhibiting excellent magnetic properties and suitable for use as the material for the core of a transformer or the like.

2. Description of the Prior Art

Since grain-oriented electrical steel sheet is used mainly as a core material for transformers and other electrical equipment, it is required to exhibit excellent magnetic properties, most notably excellent magnetization property and core loss property. Magnetization property is generally expressed as the flux density $B_8$ value at a magnetic field of 800 A/m, and core loss property is expressed as the $W_{17/50}$ core loss value at a frequency of 50 Hz and a magnetization to 1.7 Tesla.

The main factor governing core loss property is flux density. Generally speaking, the higher the flux density, the better is the core loss property. Notwithstanding, increasing the flux density causes the secondary recrystallization grain size to be enlarged simultaneously and, to the extent that it does, has a degrading effect on the core loss property. In contrast, magnetic domain control enables an improvement in core loss property irrespective of the secondary recrystallization grain diameter.

Grain-oriented electrical steel sheet is produced with use of secondary recrystallization phenomenon in the final annealing step so as to develop a Goss texture wherein the grains have their (110) axes aligned with the sheet surface and their <001> axes aligned with the rolling direction. For obtaining good magnetic properties, the easily magnetizable <001> axis has to have a high degree of alignment with the rolling direction.

JP-B-40-15644 and JP-B-51-13469 teach typical methods for producing a high flux density grain-oriented electrical steel sheet. JP-B-40-15644 describes a method using MnS and AlN as the main inhibitors and JP-B-51-13469 describes a method of using MnS, MnSe, Sb and the like as the main inhibitors. Appropriate control of the size, morphology and distribution of the precipitates functioning as inhibitors is therefore an indispensable requirement in the currently available technology.

On the other hand, owing to the desire of transformer manufacturers to increase the energy efficiency and lower the cost of their products, the laminated core sector has experienced increasing need for thick grain oriented electrical steel sheet enabling a reduction in the number of laminations. Moreover, the large rotating machine sector has also long showed an interest in using grain-oriented electrical steel sheet. Here again the need is particularly high for thick grain-oriented electrical steel sheet that allows the number of laminations to be reduced.

Since increasing sheet thickness generally leads to degradation of core loss property, a strong need has arisen for the development of a thick grain-oriented electrical steel sheet with excellent magnetic properties.

SUMMARY OF THE INVENTION

The object of this invention is to provide a thick grain-oriented electrical steel sheet exhibiting good magnetic properties.

DETAILED DESCRIPTION OF THE INVENTION

Figure 1:
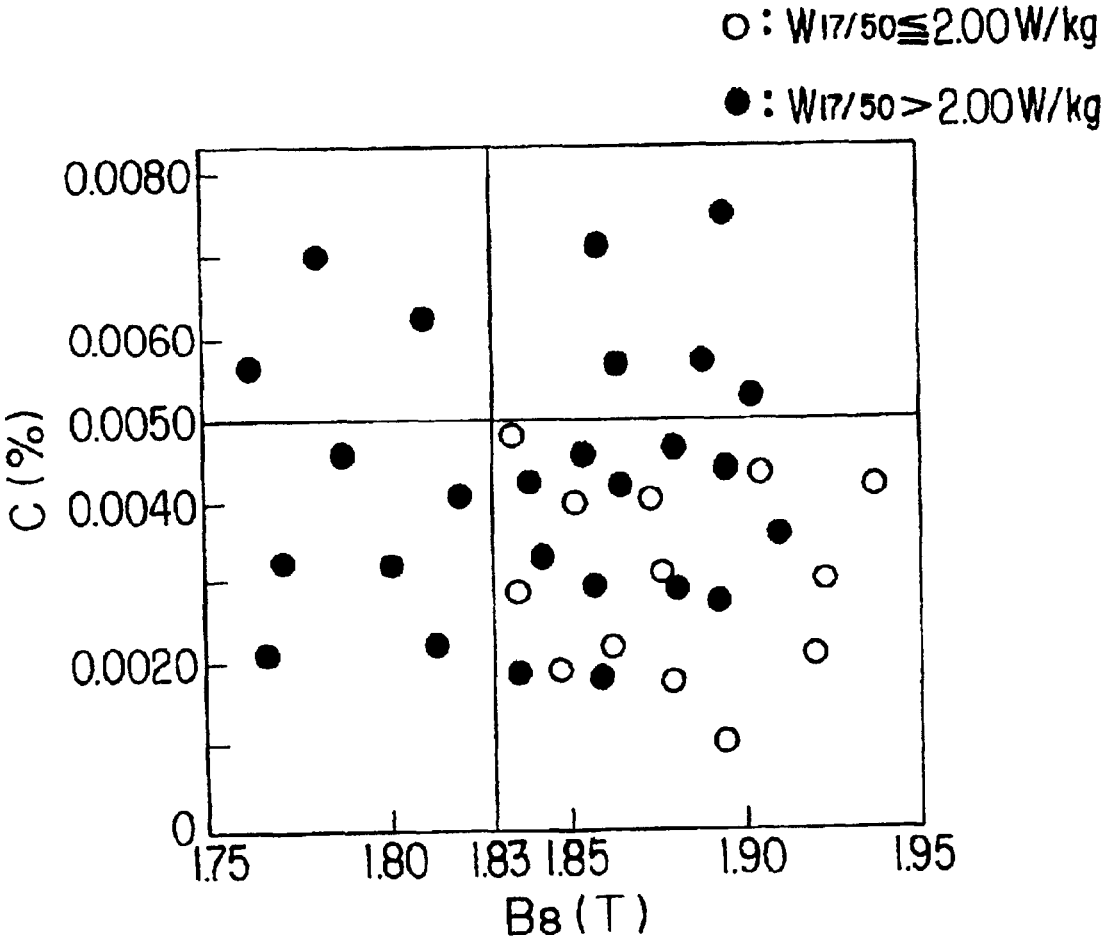
FIG. 1 is a graph showing how the core loss property of a product sheet is affected by its carbon content and flux density.

This invention provides a grain-oriented electrical steel sheet with excellent magnetic properties, the electrical steel sheet containing 2.5–4.5% Si by weight, measuring 0.36–1.00 mm in thickness, having a C content of not greater than 0.0050% by weight, exhibiting a magnetic flux density $B_8$ of not less than 1.83 T, exhibiting an SF(average value) of less than 0.80, where SF is an index representing the boundary configuration characteristics of the individual sheet grains with the same area as the circle with diameter exceeding 5 mm has and is defined as $SF=(\text{grain area}\times 4\pi)/(\text{grain boundary length})^2$, the SF (average value) being the average value of the individual SF values, its grains of a diameter exceeding 5 mm having a crystal orientation deviation of 0.2–4 degrees in relation to the crystal orientation at the grain center of gravity, and, as a product sheet of a thickness t (mm), exhibiting a core loss $W_{17/50}$ (w/kg) of not more than $3.3\times t+0.35$.

The grain-oriented electrical steel sheet of the present invention is produced by sequentially conducting the steps of casting molten steel obtained by a conventional steel-making method either continuously or by the ingot making method, if the ingot making method is used slabbing the ingot to obtain a slab, hot rolling the slab to obtain a hot-rolled sheet, annealing the hot-rolled sheet as required, subjecting the sheet to a one stage cold rolling or two or more stages of cold rolling with intermediate annealing, decarburization annealing the cold-rolled sheet, and subjecting the decarburized sheet to final finish annealing.

The inventors made a broad-based study of the conditions required for realizing good magnetic properties in the process for producing thick grain-oriented electrical steel sheet. This enabled them to ascertain the requirements that must be met by the product.

JP-A-3-72027 and U.S. Pat. Nos. 3,969,162, 4,054,471 and 4,318,758 describe methods of manufacturing grain-oriented electrical steel sheet.

In the prior art, manufacturers focused on reducing the thickness of the sheets in order to improve the core-loss properties of the grain-oriented electrical steel sheet. Specifically, it shows a thinning of such sheet from 0.35 mm to 0.23 mm.

In the manufacturing methods of the prior art, for metallurgical reasons (high temperature slab heating), in the initial phase (the melt preparation step), it was necessary to have a carbon content that was higher than required. In the final product, it was necessary that the carbon content did not exceed 0.0050%, so decarburization was included as an intermediate step. Because the ease of the decarburization was inversely proportional to the thickness of the sheet and, moreover, dense oxidation layers were formed during the decarburization, it was necessary to submit thick sheet (over 0.35 mm) to two decarburization passes, between which pickling had to be used to remove oxidation layers possessing decarburization-difficulty. This greatly increased the manufacturing costs, making the manufacturing process commercially unfeasible. For example, because the difference between 0.35 mm and 0.40 mm is the square of the thickness, the difference in terms of decarburization properties was 31%, rather than the 14%.

However, in the manufacture of transformers, the steel cores of the transformers are formed by stacking layers of grain-oriented electrical steel sheet to achieve the required core size. This means that it takes less work if the sheets used are thicker, enhancing productivity. However, because of the reasons cited above, using thicker sheets is too costly to be practical. For transformer manufacturers, the trade-off point between manufacturing ease (including cost) and the desire for thicker sheets was 0.35 mm, which was the thickness used in commercial products in the prior art. That is, mathematically, there is little difference between 0.35 mm and 0.36 mm, but in terms of the method of manufacturing the grain-oriented electrical steel sheets, 0.36 mm was the critical point. In terms of use by customers, there is a tremendous difference between product sheet up to 0.35 mm and product sheet that is 0.36 mm or thicker. In terms of the process of manufacturing transformers, compared to 0.35 mm sheets, using 0.40 mm sheet reduces the number of stacking steps by 14%, and use of 0.50 mm sheets reduces the number of steps by 43%. Since transformers is a labor-intensive industry, being able to reduce the number of stacking steps by over 10% is extremely valuable.

Their findings will now be explained with reference to experimental results.

FIG. 1 shows the effect of the product C content and flux density on the product core loss property.

In this experiment, a silicon steel slab comprising, by weight, 3.21–3.30% Si, 0.025–0.085% C, 0.025–0.030% acid-soluble Al, 0.0075–0.0086% N, 0.070–0.161% Mn, 0.005–0.029% S and the balance Fe and unavoidable impurities was heated at 1150–1380° C. for 1 hr, the slab was hot rolled into a 2.8 mm-thick hot-rolled sheet, one portion of the hot-rolled sheet was annealed at 900–1100° C. and another portion thereof was not annealed, and the sheets were cold rolled at a reduction ratio of about 83% to a thickness of 0.48 mm.

The so-obtained cold-rolled sheets were subjected to decarburization annealing (atmosphere: 25% $N_2$ and 75% $H_2$; dew point: 65° C.) in the temperature range of 810–860° C. for 250 sec. Then, a portion of each sheet was subjected to nitriding treatment, with which N was increased by 0.0102–0.0195%, using $NH_3$ gas during 750° C.×30 sec additional annealing and another portion of each sheet was not subjected to nitriding treatment. The sheets were coated with an annealing separation agent consisting mainly of MgO, the coated sheets were rolled into (5-ton) coils measuring 200–1500 mm in inside diameter, the coils were subjected to final finishing annealing by heating to 1200° C. at a temperature increase rate of 15° C./hr in an annealing atmosphere containing 10–100% $N_2$ (remainder $H_2$), and by holding them at 1200° C. for 20 hr in an $H_2$ annealing atmosphere.

The coils were applied with a tensile coating and then cut to a size for a single sheet tester, flattened, maintained at 850° C. for 4 hr for strain relieving annealing, whereafter the magnetic properties were measured. The final product thickness was 0.50 mm.

As is clear from FIG. 1, products exhibiting a good core loss property, namely a $W_{17/50}$ of not greater than 2.00 w/kg, were obtained only under the conditions of a carbon content of not more than 0.0050% and a flux density $B_8$ of not less than 1.83 T. Even when these conditions were met, however, there were cases where the $W_{17/50}$ was greater than 2.00 w/kg. The reason for this was carefully investigated.

The results of the investigation will be explained in the following.

Figure 2:
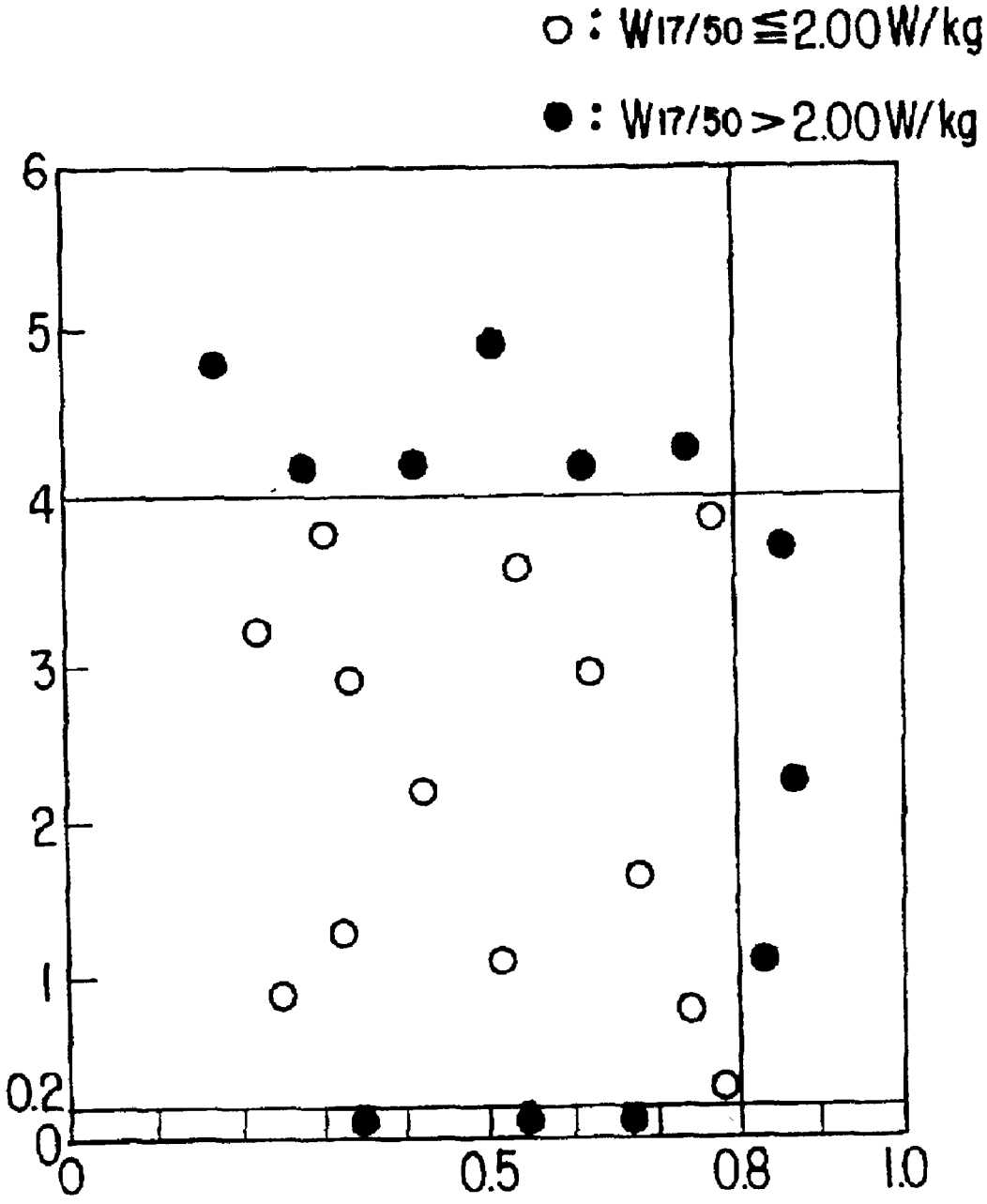
FIG. 2 is a graph showing how the core loss property of a product sheet is affected by the shape factor of the grain boundary and the deviation degree of crystal orientation in the grains.

FIG. 2 relates to those among the products of the test of FIG. 1 which had a carbon content of not more than 0.0050% and a flux density $B_8$ of not less than 1.83 T and shows how the core loss property of these products was affected by the shape factor (SF) of the grain boundary of grains with the same area as the circle with diameter exceeding 5 mm has and the deviation degree (Δθ) of crystal orientation in grains of a diameter exceeding 5 mm.

The grain boundary shape factor (SF) was defined as $$SF=(\text{grain area}\times 4\pi)/(\text{grain boundary length})^2,$$

and used to quantify grain boundary configuration. The value of SF is 1 for a circular grain and decreases with increasing irregularity (bumpiness) of the grain boundary configuration.

The deviation degree (Δθ) of crystal orientation in grains of a diameter exceeding 5 mm represents the difference in orientation in the grain in relation to that at the grain center of gravity. When, as in the present invention, secondary recrystallization is evolved in the coiled state and the coil is thereafter flattened to provide the product, the crystal orientation deviation (Δθ) in the grains generally tends to increase with increasing distance from the center of gravity in the rolling direction.

SF was measured by image analysis and Δθ was measured using Electron Channeling Pattern (ECP).

Each dot in FIG. 2 corresponds to an SST-sized specimen produced under the experimental conditions of FIG. 1. SF is expressed as the average value (SF (average value)) for 101–151 grains with diameters greater than 5 mm, and Δθ is expressed as the average value (Δθ (average value)) of the maximum orientation deviations (difference in orientation between that at the center of gravity and that at the point furthest from the center of gravity in the rolling direction) of 81–113 grains.

As is clear from FIG. 2, all products satisfying the conditions of SF (average value)<0.80 and Δθ (average value) (deg)=0.2–4 exhibited a good magnetic property of $W_{17/50}\leqq 2.00$ w/kg.

To advance their study further, the inventors produced products measuring 0.36–1.00 mm in thickness with slabs, as starting materials, the same as those used in the explanation of FIG. 1 under the same processing conditions as explained with regard to FIG. 1 except that the thickness of the hot-rolled sheets was 2.3–5.0 mm.

Figure 3:
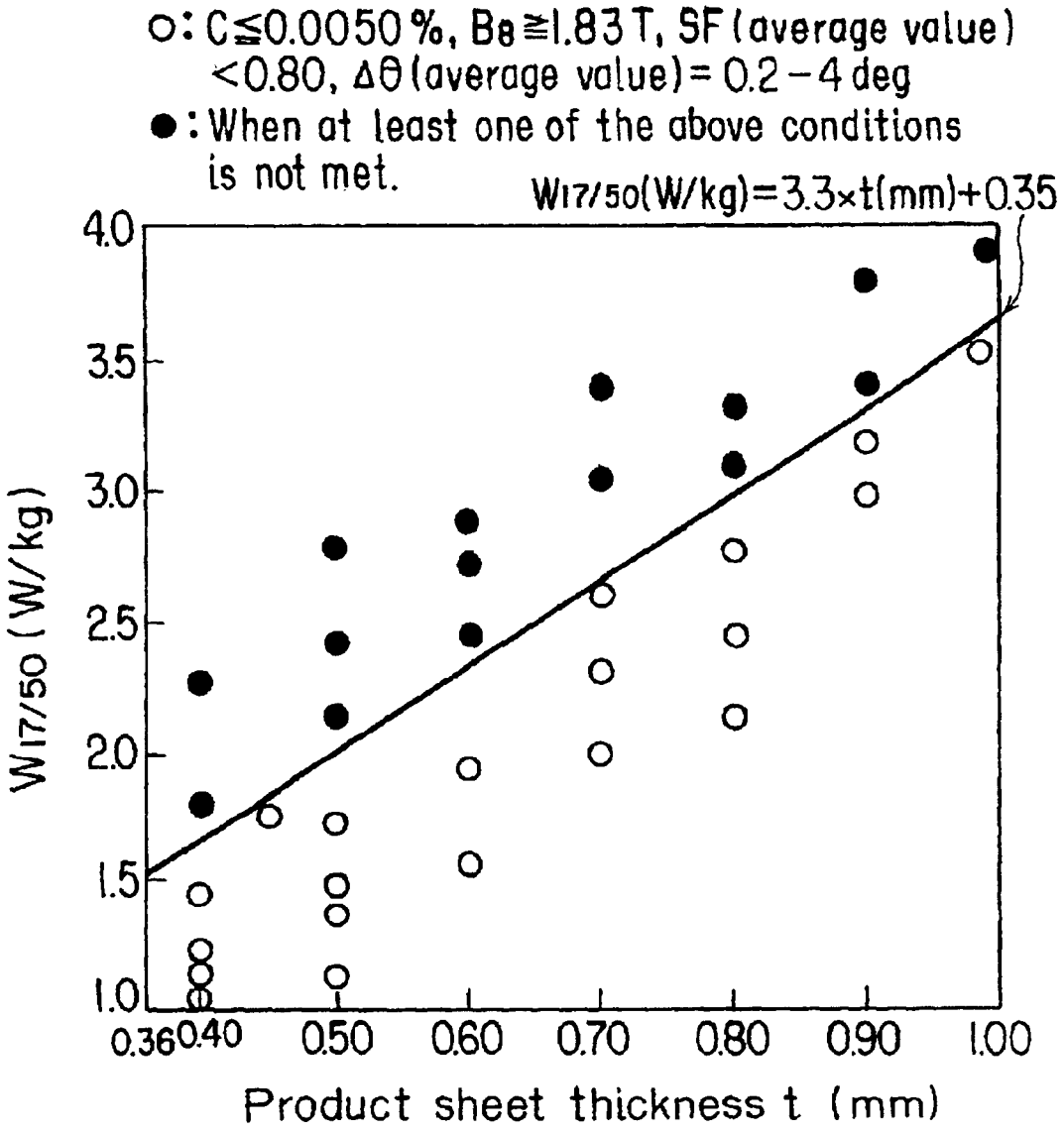
FIG. 3 is a graph showing how the core loss property of a product sheet is affected by sheet thickness, in products according to the invention and in comparison products.

The experimental results for these products are shown in FIG. 3.

As is clear from FIG. 3, the products satisfying all conditions of the present invention, namely the conditions of C≦0.0050%, $B_8$≧1.83 T, SF (average value)<0.80 and Δθ (average value) (deg)=0.2–4, exhibited an excellent core loss property $W_{17/50}$ of not greater than 3.3×t+0.35 (where $W_{17/50}$ is the core loss property in w/kg and t is the product thickness in mm).

Although the mechanism by which the invention produces its effect has not been ascertained with complete certainty, the inventors have reached the tentative conclusion set out in the following.

While core loss property improves with increasing flux density, the improvement is generally diminished in proportion to the extent that the increase in magnetic flux density causes the large grain diameter simultaneously. When the sheet thickness is large as in the present invention, however, the likelihood of the product grains becoming excessively large tends to be low. This means that in the case of a thick product such as in this invention the correlation between magnetic flux density and core loss becomes more clearly defined.

On the other hand, residual C in the product forms carbides which prevent movement of the magnetic domain walls during magnetization, thus degrading the core loss property. In the case of a thick product such as in the present invention, the likelihood of insufficient decarburization in the decarburization annealing step is high and, therefore, restriction of the product C content is particularly important.

The basic principle underlying the present invention is that of achieving a specified combination of product grain boundary configuration and crystal orientation deviation. The tendency for spike magnetic domains to form in the vicinity of the grain boundaries becomes even more remarkable when crystal orientation deviation is present in the grains.

Moreover, when the irregularity of the grain boundary configuration becomes high (SF becomes low) as in this invention, the resulting enlargement of the grain boundary area increases the frequency of spike magnetic domain occurrence. The increased number of spike magnetic domains produced by the invention causes magnetic domain refinement when the tension is imparted to the sheet by the glass film and coating, in this way improving the core loss property.

In the case of a thick sheet as in the present invention, since it is difficult to realize a magnetic domain refinement effect only by a simple expedient (such as increasing the tension imparted to the sheet), it becomes necessary to achieve a good core loss property by combining grain boundary configuration control and in-grain crystal orientation deviation control as in this invention.

The reason for the limits placed on the constituent features of the invention will now be explained.

Although there are no particular limits on the composition of the slab used in the invention, in order to stabilize the product magnetic flux density and facilitate decarburization to the required level, the C content of the slab is preferably in the range of 0.025–0.075% by weight.

For achieving improved core loss property, the product sheet according to the invention preferably contains 2.5–4.5% Si. Al, N, Mn, S, Se, Sb, B, Cu, Nb, Cr, Sn, Ti, Bi etc. can be added as inhibitor-forming elements. While no particular limit is set on the temperature at which the slab is heated, energy cost considerations and the like make it preferable to use a heating temperature of not more than 1300° C. The heated slab is subjected to hot rolling into a hot-rolled sheet in the following step. The hot-rolled sheet is annealed as required and the sheet is then subjected to a one stage cold rolling or two or more stages of cold rolling with intermediate annealing, for reducing it to the final sheet thickness.

The reduction ratio in the final cold rolling is not particularly limited but a reduction ratio of not less than 80% is preferable from the point of increasing the product magnetic flux density ($B_8$ value). Using a reduction ratio of not less than 80% in the final cold rolling ensures that the decarburization annealed sheet has appropriate amounts of sharp {110} <001> oriented grains and coincident orientation grains ({111} <112> oriented grains or the like) which are likely to be eroded by the {110} <001> oriented grains. This makes it possible to obtain a $B_8$ of not less than 1.83 T.

After the final cold rolling, the cold-rolled sheet is subjected to decarburization annealing at 700–1000° C. Since the product according to the invention is thick (0.36–1.00 mm), the time required for decarburization to the required level tends to be long. For shortening the required time, it is helpful to lower the C content of the molten steel, increase the decarburization annealing temperature, and/or raise the dew point of the annealing atmosphere.

That is, preferably, sheets cold-rolled to a final thickness are subjected to decarburization annealing for 120 seconds to 250 seconds at 800° C. to 900° C. in an atmosphere of 25% $N_2$, 75% $H_2$ with a dew point of 60° C. to 75° C.

If the inhibitor strength is insufficient for evolving secondary recrystallization in the decarburized sheet, it is preferable to carry out nitriding treatment using $NH_3$ gas or some other inhibitor strengthening measure.

That is, sheets that have been decarburization-annealed are subjected to nitriding treatment for 10 to 60 seconds at 7000° C. to 900° C. in an atmosphere of dry $NH_3$ gas to bring the total N content to within 0.010 to 0.027 weight percent.

After the sheet has been coated with an annealing separation agent consisting mainly of MgO, it is rolled into a coil having an inside diameter of 10–100,000 mm and then subjected to final finish annealing. When the inside diameter is in this range during finish annealing, the presence of a 0.2–4 deg crystal orientation deviation in relation to that at the grain center of gravity can be ensured in the sheet grains exceeding 5 mm in diameter.

The final product is then obtained by subjecting the sheet to strain relieving and application of a tensile coating. For improving the core loss property of the product, it is preferable to subject it to magnetic domain control using a laser beam or the like.

The final product sheet is required to have an Si content by weight of 2.5–4.5%. At a content below 2.5%, it is hard to obtain a good core loss property, while at a content above 4.5% there arises a problem of brittleness during ordinary cold rolling.

The product according to this invention is thick. Specifically it has a thickness of 0.36–1.00 mm. A sheet of a thickness of less than 0.36 mm may in some cases be able to achieve a good core loss property without satisfying the conditions of this invention. A sheet exceeding 1.00 mm is undesirable because the time required for decarburization to the level required by the invention becomes so long as to cause an intolerable increase in production cost.

The product has to have a C content of not greater than 0.0050% and a flux density $B_8$ of not less than 1.83 T. This is because, as shown in FIG. 1, these are the ranges required for obtaining a good core loss property. A C content of not more than 0.0030% is preferred.

The shape factors SF representing the boundary configuration characteristics of the sheet grains with the same area as the circle with diameter exceeding 5 mm has are required to have an average value (an average value for the sheet called the "SF (average value)") of less than 0.80.

The deviation degree ($\Delta\theta$) of crystal orientation in grains of a diameter exceeding 5 mm is required to be in the range of $\Delta\theta$=0.2–4 deg. This is because, as shown in FIG. 2, this is the range required for obtaining good core loss property.

The invention is not limited to any particular method for controlling the SF value and it is possible to select from among control of the primary recrystallization grain diameter before occurrence of secondary recrystallization, use of a grain boundary segregation elements such as Sn, and adjustment of inhibitor strength during secondary recrystallization.

The invention is not limited to any particular method for controlling the $\Delta\theta$ value and it is possible either to conduct final finish annealing with respect to a coil of a diameter suitable for the product grain diameter or to use the heat history between solidification and slab heating to control the slab grain size. As regards the effect of this $\Delta\theta$, the presence of the prescribed crystal orientation deviation in even a single grain results in an improvement in core loss property.

If the foregoing product requirements are satisfied, there is obtained a thick grain-oriented electrical steel sheet exhibiting a good core loss property $W_{17/50}$ of not greater than 3.3×t+0.35 (where W17/50 is the core loss property in w/kg and t is the product thickness in mm).

By utilizing the combined effect of the product sheet C content control, the magnetic flux density control, the grain boundary configuration control and the in-grain crystal orientation deviation control according to this invention, it is possible to obtain a thick grain-oriented electrical steel sheet exhibiting excellent magnetic properties. The invention can therefore be expected to make a highly significant contribution to industry.

EXAMPLES

Example 1

A slab comprising, by weight, 0.053% C, 3.26% Si, 0.15% Mn, 0.006% S, 0.029% acid-soluble Al, 0.0076% N and the balance Fe and unavoidable impurities was heated at 1150° C. and then hot rolled into a 2.8 mm hot-rolled sheet.

The hot-rolled sheet was annealed by being held at 1120° C. and then at 900° C., the annealed sheet was subjected to cold rolling at a reduction ratio of about 86% to a thickness of 0.38 mm. One portion of the sheet (1) was decarburization-annealed at 800° C. for 150 sec, a second portion (2) at 830° C. for 150 sec, and a third portion (3) at 860° C. for 200 sec, (atmosphere: 25% $N_2$ and 75% $H_2$; dew point: 65° C.). The annealed sheets were then subjected to nitriding treatment by annealing at 7500° C. for 30 sec in an annealing atmosphere containing $NH_3$ gas.

The N content of the sheets after the nitriding treatment was 0.0195–0.0211 wt %. The sheets were then coated with an annealing separation agent consisting mainly of MgO, rolled into 5-ton coils having an inside diameter of 600 mm and then subjected to final finish annealing in which they were heated to 1200° C. at 15° C./hr and held at 1200° C. for 20 hr.

Figure 4:
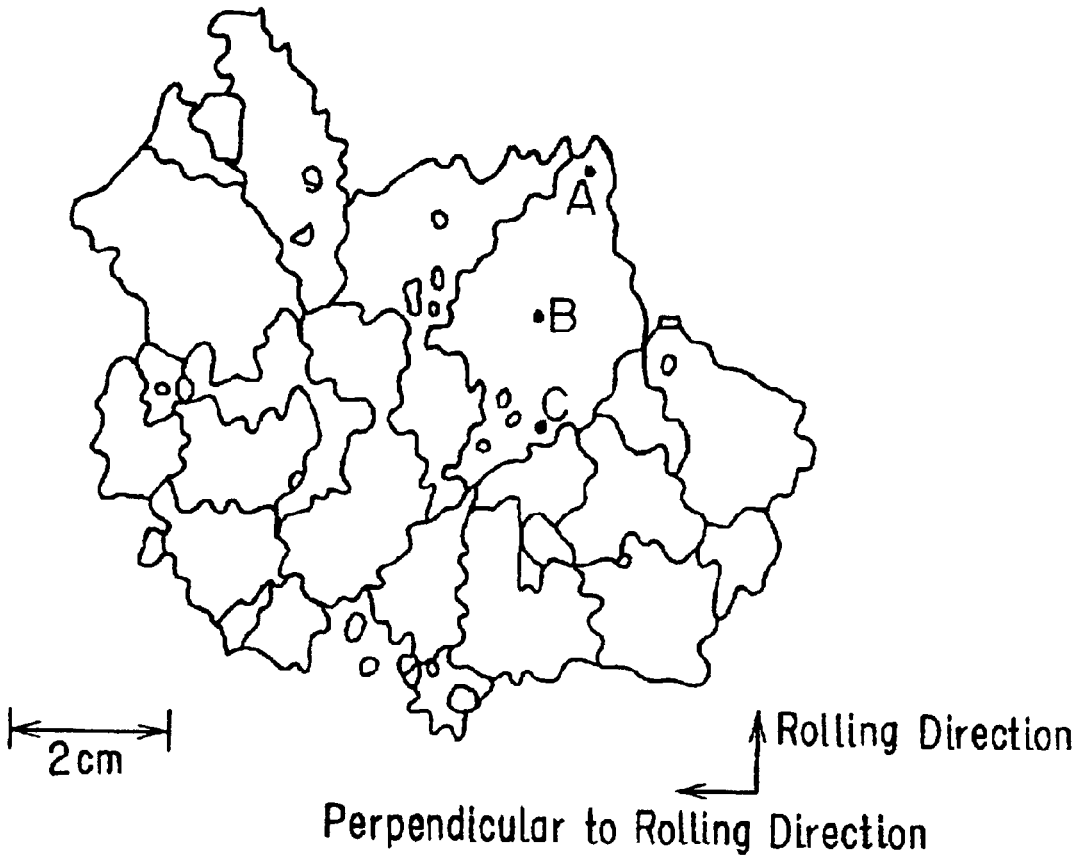
FIG. 4 shows a typical grain pattern of a thick grain-oriented electrical steel sheet according to the invention.

In this final finish annealing, an atmosphere of (25% $N_2$+75% $H_2$) was used during the temperature increase phase and an atmosphere of 100% $H_2$ was used during the 1200° C. holding phase. The coils were then coated with a tensile coating and cut into SST-sized specimens, flattened, strain-relief annealed at 850° C., and tested for magnetic properties. The final product sheet thickness was 0.40 mm. Table 1 shows the property values of the sheets treated under the respective conditions. FIG. 4 shows the grain pattern of the thick grain-oriented electrical steel sheet according to the invention. In this figure, B denotes the center of gravity of the grain. The crystal orientation difference between B and A was 3 deg and that between B and C 2.4 deg.

TABLE 1

| Processing conditions | C (%) | Product Sheet Properties $B_8$ (T) | SF | $\Delta\theta$ (deg) | $W_{17/50}$ (w/kg) | Remarks |
|---|---|---|---|---|---|---|
| (1) | 0.0027 | 1.82 | 0.82 | 2.1 | 1.74 | Comparison |
| (2) | 0.0020 | 1.92 | 0.54 | 1.2 | 1.19 | Invention |
| (3) | 0.0015 | 1.80 | 0.50 | 1.3 | 1.81 | Comparison |

Remark: SF and $\Delta\theta$ are the average values defined in the text.

Example 2

A first slab (1) comprising 0.045% C, 3.01% Si, 0.14% Mn, 0.008% S, 0.035% acid-soluble Al, 0.0061% N, 0.05% Sn and the balance Fe and unavoidable impurities and a second slab (2) of the same composition except that the Sn content was less than 0.01% were heated at 1150° C. and hot rolled to a thickness of 2.3 mm.

Without being annealed, the hot-rolled sheets were subjected to cold rolling at a reduction ratio of about 79% to a thickness of 0.48 mm. The cold rolled sheets were annealed at 830° C. for 300 sec (atmosphere: 25% $N_2$ and 75-% $H_2$; dew point: 62° C.) and were thereafter treated under the same conditions as those of Example 1. The thickness of the final product sheets was 0.50 mm. Table 2 shows the property values of the sheets treated under the respective conditions.

TABLE 2

| Processing conditions | C (%) | Product Sheet Properties $B_8$ (T) | SF | $\Delta\theta$ (deg) | $W_{17/50}$ (w/kg) | Remarks |
|---|---|---|---|---|---|---|
| (1) | 0.0020 | 1.89 | 0.60 | 1.5 | 1.49 | Invention |
| (2) | 0.0015 | 1.88 | 0.49 | 1.1 | 1.54 | Invention |

Remark: SF and $\Delta\theta$ are the average values defined in the text.

Example 3

A first slab (1) comprising 0.078% C, 3.21% Si, 0.12% Mn, 0.009% S, 0.034% acid-soluble Al, 0.0060% N and the balance Fe and unavoidable impurities, a second slab (2) of the same composition except that the C content was 0.053%, and a third slab (3) of the same composition except that the C content was 0.039% were heated at 1200° C. and hot rolled to a thickness of 3.0 mm.

Without being annealed, the hoc-rolled sheets were subjected to cold rolling at a reduction ratio of about 81% to a thickness of 0.58 mm. The cold rolled sheets were annealed at 830° C. for 450 sec (atmosphere: 25% $N_2$ and 75% $H_2$; dew point: 62° C.) and were thereafter treated under the same conditions as those of Example 1. The thickness of the final product sheets was 0.60 mm.

Table 3 shows the property values of the sheets treated on the respective conditions.

TABLE 3

| Processing conditions | C (%) | $B_8$ (T) | SF | Δθ (deg) | $W_{17/50}$ (w/kg) | Remarks |
|---|---|---|---|---|---|---|
| | Product Sheet Properties | | | | | |
| (1) | 0.0058 | 1.82 | 0.60 | 1.3 | 2.41 | Comparison |
| (2) | 0.0026 | 1.90 | 0.57 | 1.1 | 1.70 | Invention |
| (3) | 0.0015 | 1.86 | 0.65 | 2.4 | 1.89 | Invention |

Remark: SF and Δθ are the average values defined in the text.

What is claimed is:

1. In a method for producing a thick grain-oriented electrical steel sheet with excellent properties, the method comprising:

preparing a slab consisting essentially of, by weight, 0.025–0.075% of C, 2.5–4.5% of Si, 0.025–0.035% of acid soluble Al, 0.0060–0.0086% of N, 0.070–0.161% of Mn, 0.005–0.029% of S, one or more elements selected from the group consisting of Se, Sb, Cu, Nb, Cr, Sn, Ti and Bi, and the balance being iron and unavoidable impurities;

heating the slab to a temperature not higher than 1,300° C., hot rolling the slab to a hot-rolled sheet, optionally annealing the hot-rolled sheet, cold rolling the hot rolled sheet to a cold-rolled sheet by a reduction ratio of not less than 80% by using a one stage cold rolling or two or more stages of cold rolling with intermediate annealing, said cold rolling providing the sheet with a final thickness of 0.36–1.00 mm, decarburization annealing the cold-rolled sheet for decarburization of the sheet at a temperature of 700–1,000° C., treating the cold-rolled sheet for nitriding by using $NH_3$ gas, and final annealing, setting C-content to not greater than 0.0050% by weight after decarburization annealing of the sheet, setting total N-content to 0.010–0.027% by weight after nitriding treatment of the sheet in $NH_3$ gas following said decarburization annealing, coating the nitrided sheet with an annealing separation agent consisting essentially of MgO and subjecting the coated sheet to final annealing as a coil having a coil inside diameter within a range of 200–1500 mm to obtain grains of a selected diameter, its grains of a diameter exceeding 5 mm having a crystal orientation deviation (Δθ) of 0.2–4 degrees in relation to that at the grain center, and a post-final-annealing SF value of less 0.80, where SF is defined as $$SF=(\text{grain area}\times 4\pi)/(\text{grain boundary length})^2,$$

whereby a magnetic flux density $B_8$ of the sheet is not less than 1.83 T and core loss $W_{17/50}$ (w/kg) of the sheet is not more than 3.3×t+0.35.

2. The method according to claim 1, comprising:

final annealing the coil adjusted to a coil inside diameter of 600 mm.

3. The method according to claim 1, comprising:

decarburization annealing of the cold-rolled sheet for 120 seconds to 250 seconds at 800° C. to 900° C. in an atmosphere of 25% $N_2$, 75% $H_2$ with a dew point of 60° C. to 75° C.; and following said decarburization annealing, subjecting the sheet to nitriding treatment for 10 to 60 seconds at 700° C. to 900° C. in an atmosphere of dry $NH_3$ gas.

* * * * *